US006382005B1

(12) United States Patent
White et al.

(10) Patent No.: US 6,382,005 B1
(45) Date of Patent: May 7, 2002

(54) GARAGE DOOR LOCKING APPARATUS

(76) Inventors: Bryan A. White, 1215 Bridgehampton St., San Marcos, CA (US) 92069; Clyde D. Herman, 11976 Calle Deposito, El Cajon, CA (US) 92019

( * ) Notice: Subject to any disclaimer, the term of this patent is extended or adjusted under 35 U.S.C. 154(b) by 0 days.

(21) Appl. No.: 09/419,931

(22) Filed: Oct. 18, 1999

(51) Int. Cl.[7] ..... E05B 47/00

(52) U.S. Cl. ..... 70/277; 49/199; 49/450; 160/188; 292/144

(58) Field of Search ..... 70/277; 292/36, 292/38, 144, 201, 216; 160/188, 189, 201; 49/197–199, 280, 450; 74/625

(56) References Cited

U.S. PATENT DOCUMENTS

| | | | | | |
|---|---|---|---|---|---|
| 3,543,441 | A | | 12/1970 | La Porte | 49/450 |
| 3,996,591 | A | | 12/1976 | Hayward | 343/225 |
| 4,254,582 | A | | 3/1981 | McGee | 49/199 |
| 4,443,033 | A | * | 4/1984 | D'Anna | 292/235 |
| 4,480,863 | A | * | 11/1984 | Hormann | 292/216 |
| 4,606,566 | A | * | 8/1986 | Bott | 292/57 |
| 4,659,121 | A | | 4/1987 | McGee | 292/144 |
| 4,668,899 | A | | 5/1987 | Ide et al. | 318/280 |
| 4,739,584 | A | | 4/1988 | Zellman | 49/199 |
| 4,771,218 | A | | 9/1988 | McGee | 318/16 |
| 4,794,732 | A | | 1/1989 | Elardi | 49/280 |
| 4,819,379 | A | | 4/1989 | Kenzelmann et al. | 49/280 |
| 4,884,831 | A | | 12/1989 | Emon | 292/38 |
| 4,905,542 | A | * | 3/1990 | Burn et al. | 49/360 X |
| 4,917,419 | A | | 4/1990 | Mora, Jr. et al. | 292/144 |
| 4,996,795 | A | | 3/1991 | Niswonger | 49/280 |
| 5,222,403 | A | * | 6/1993 | Angelini et al. | 49/139 X |
| 5,245,879 | A | | 9/1993 | McKeon | 74/2 |
| 5,284,199 | A | * | 2/1994 | Finch et al. | 160/133 |
| 5,444,440 | A | | 8/1995 | Heydendahl | 340/825.32 |
| 5,544,924 | A | * | 8/1996 | Paster | 160/201 X |
| 5,698,073 | A | * | 12/1997 | Vincenzi | 160/188 |
| 5,790,034 | A | | 8/1998 | Khoury | 340/574 |
| 6,145,570 | A | * | 11/2000 | Mullet et al. | 160/191 |

* cited by examiner

*Primary Examiner*—Suzanne Dino Barrett
(74) *Attorney, Agent, or Firm*—Jack C. Mumro

(57) ABSTRACT

A remote controllable dead bolt type of locking apparatus is to be retrofittedly mounted in conjunction with a conventional garage door which is to function to securely lock the garage door preventing unauthorized entry through the garage door. The locking apparatus uses an elongated draw bar assembly that connects between the right side door jamb and the left side door jamb which defines the transverse sides of the opening within which is mounted the garage door. The draw bar assembly is to be linearly moved by a draw bar drive which is to be electrically activated when operating of a hand held remote that operates the conventional garage door opening mechanism.

6 Claims, 10 Drawing Sheets

GARAGE DOOR LOCKING APPARATUS

BACKGROUND OF THE INVENTION

1) Field of the Invention

The field of this invention relates to door locks and more particularly to a door locking apparatus for a conventional garage door which may be operated by the remote controlled automatic garage door operating mechanism that is commonly mounted in conjunction with garage doors.

2) Description of the Prior Art

Automatic garage door opening mechanisms have now become exceedingly common in conjunction with garage doors of residences such as houses, condominiums and apartments. These garage door opening mechanisms are principally for the purpose of allowing the user the convenience to open his or her garage door by a radio actuated switch which is commonly referred to as a remote. Garage door operating mechanisms are also intended to provide security for the garage door so that when the garage door is in the closed position, the garage door is to be maintained closed unless it is actuated only by the individual with the remote. However, this has been known to impart a false sense of security for the garage door as residential burglary is commonly achieved by entry of the burglars through the garage door.

A common form of garage door is constructed of a single flat piece with the flat piece to be pivoted from a vertically oriented position when the garage door is closed to a substantially horizontal position when the garage door is open. When the garage door is in the closed position, it is possible for a burglar to pry open a bottom corner of the door, particularly of a double car door, a sufficient distance to allow a small person to wiggle through the produced opening and gain entrance to the interior of the garage. Once in the garage, the burglar will have access to a push button to open the garage door and generally has access to the interior of the residence through an access door into the garage. After burglarizing of the residence, the burglar may load burglarized goods into a vehicle that is located within the garage, then start the vehicle, open the garage door and proceed with an unnoticed escape. In the past, it has been known to provide solenoid actuated latches in the lower corners of the garage door that when latched will prevent a person from wiggling through a pried up corner of the door. However, these solenoid types of latches are normally large in size and inherently expensive. Also, the mounting arrangement for the solenoid latches is complex with this complexity greatly increasing the cost of installation of such a locking arrangement.

In the past it has been known to utilize a separate manual garage door locking mechanism. While satisfactory for their intended purpose, such manually operated locking mechanisms are not readily adaptable for use with garage doors that incorporate automatic openers as such would not provide the convenience of automatic operation. In other words, with an individual approaching the garage door with one's car, it would require that the individual leave the car, go the garage door and open the garage door and then get back into the car and then move the car within the garage. The individual then would be required to exit the car and then close the garage door prior to entry within the residence. It is far more convenient to use a remotely operated opening mechanism which does not require that the individual leave the car in order to gain access to within the garage and then can close the garage door as the individual is entering the residence not requiring the procedure of separately closing the garage door.

SUMMARY OF THE INVENTION

The structure of the present invention is directed to a garage door locking mechanism which may be utilized on any garage door whether or not it includes an automatic garage door opening apparatus. However, the structure of the present invention is designed to be of particular advantage when used in conjunction with an automatic door opener and the present invention will be discussed primarily in conjunction with such an opener. In particular, the garage door locking apparatus of the present invention utilizes an elongated draw bar assembly that is mounted on the garage door and connects between the right side door jamb and the left side door jamb of the garage door. The draw bar assembly is to be connected in a dead bolt type of locking arrangement with these door jambs. The draw bar assembly is to be linearly movable by a drive mechanism. The drive mechanism is electrically operated and is connected to the automatic garage door opener. Actuation of the garage door opener to open the garage door will immediately move the draw bar assembly to an unlatching position which will then permit the garage door to be opened. operating of the automatic garage door opener to move the garage door from an open position to a closed position will cause the locking apparatus to be moved to a locking position once the garage door is in the closed position. The locking apparatus of this invention is to include a vacation lock feature that will permit the user to permanently affix the locking apparatus in the latched position which will not permit the garage door to be opened even with actuation of the remote. The locking apparatus is to also include a power failure release that upon the loss of electrical power, the locking apparatus can be manually moved to the unlatched position which will permit manual opening of the garage door. Also, the locking apparatus is to include a manual reset to place the locking apparatus back in the normal operating position after operation of the power failure release.

One of the primary advantages of this invention is to create a garage door locking apparatus which can be retrofitted into existing garage doors and automatic garage door openers.

Another primary advantage of this invention is to construct a garage door locking apparatus which makes it extremely difficult for a home to be burglarized by means of entry through the garage door.

Another advantage of this invention is to construct a garage door locking apparatus which can be installed in a garage door in a manner of a few minutes by individuals of limited mechanical skill.

Another advantage of this invention is to construct a garage door locking apparatus which includes a feature to unlatch the apparatus in the event an electrical power failure occurs.

Another advantage of this invention is to construct a garage door locking apparatus which includes a key operated lock which, when operated, will locate the locking apparatus in the latched position which is ideal as a "vacation lock" which maintains the locking apparatus locked while the user is away from his or her residence.

DETAILED DESCRIPTION OF THE PREFERRED EMBODIMENT

Figure 1A:
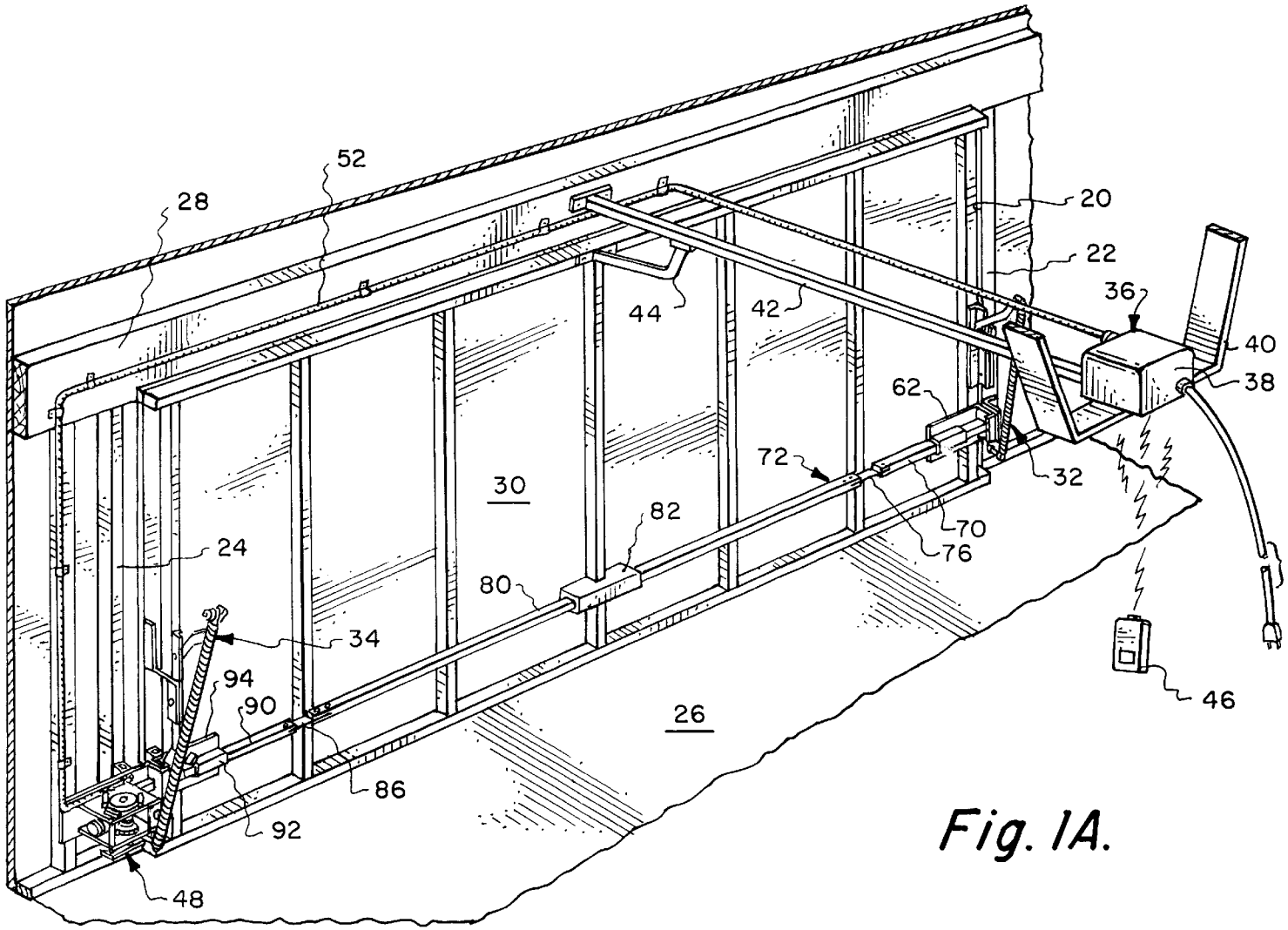
FIG. 1A is inside perspective view of a typical garage door which has installed thereon an electrically actuated garage door opener and also on which is installed the locking apparatus of the present invention.
Figure 1B:
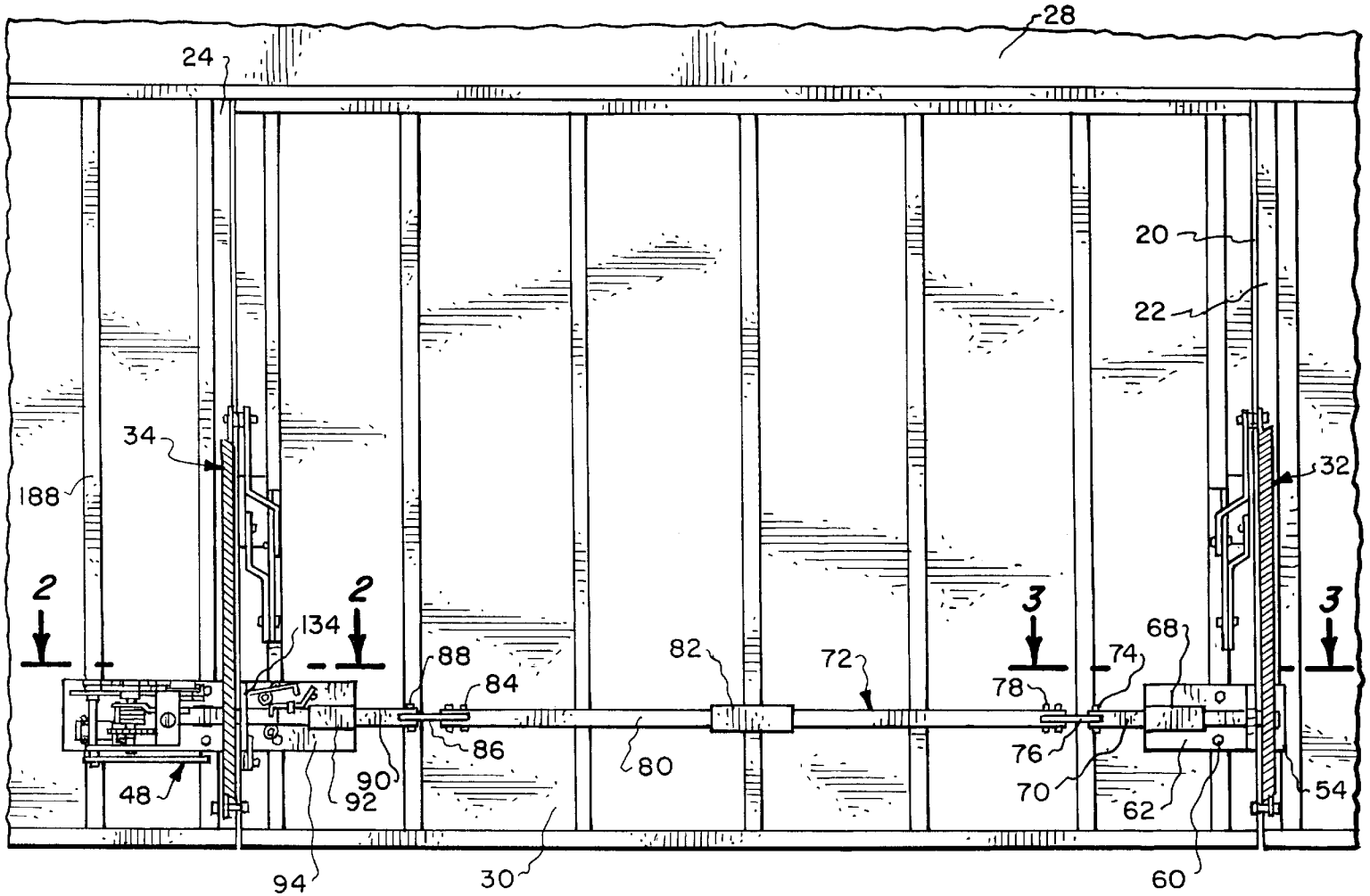
FIG. 1B is an elevational view of the inside surface of the garage door of FIG. 1.
Figure 2:
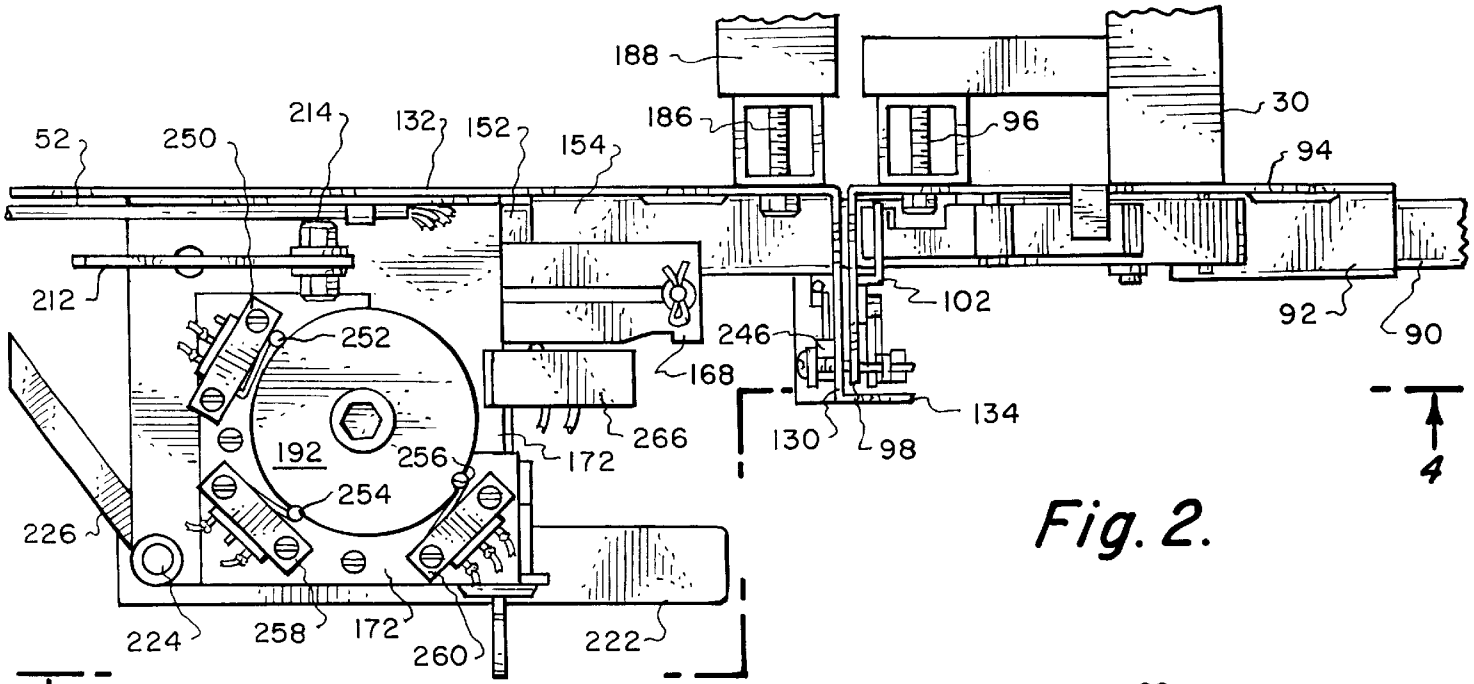
FIG. 2 is a top plan view of the drive mechanism with the draw bar assembly which is mounted on the left door jamb of the garage door opening in the locked position taken along line 2—2 of FIG. 1B.
Figure 3:
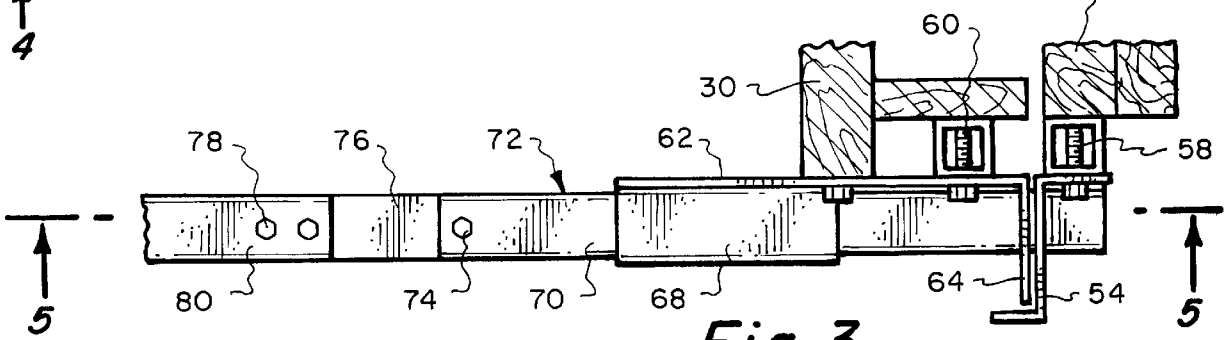
FIG. 3 is a top plan view of the dead bolt locking arrangement of the draw bar assembly that is mounted on the right side door jamb of the garage door opening taken along line 3—3 of FIG. 1B.

Referring particularly to FIGS. 1A and 1B, there is shown a garage door opening 20 which is formed between a right side door jamb 22 and a left side door jamb 24. The lower end of the opening 20 is closed by floor 26. The upper end of the opening 20 is closed by cross beam 28. A garage door 30 is mountable in a vertically oriented manner to substantially close the opening 20. The garage door 30 is counterbalancingly supported by spring assemblies 32 and 34 which will permit the garage door 30 to be opened with a low amount of force. Attached to the door 30 is an automatic garage door opener 36. The automatic garage door opener 36 includes a housing 38 which is supported on bracing support members 40 which are fixably mounted within the interior structure of the garage, which is not shown. Between the housing 38 and the cross beam 28 is mounted a rail 42. Within the rail 42 is to be located a driving mechanism, such as a chain, which is to be connected to an arm 44. The arm 44 connects directly with the garage door 30. Activation of the automatic garage door opener 36 by means of remote 46 will cause the arm 44 to move along the rail 42 with the result that the garage door 30 is moved from the closed position shown in FIGS. 1A and 1B, to the open position, which is not shown. The open position is when the garage door 30 is located substantially horizontal. Reactivation of the hand held remote 46 with the garage door in the open position will result in the garage door 30 being moved to the closed position by the automatic garage door opener 36.

The garage door locking apparatus 48 of this invention includes an electrical motor 50. This electrical motor 50 is electrically connected to an electronic controller, which is not shown, and by electrical cable 52 to within the housing 38 of the automatic garage door opener 36. It is to be understood that the automatic garage door opener 36 is to be automatically activated when the garage door locking apparatus 48 of this invention is activated. If the garage door 30 is in the closed position, and the remote 46 is operated, the garage door locking apparatus 48 will be moved to an unlatched position so as to permit the garage door 30 to be moved to its open position. When the remote 46 is activated and the garage door 30 is moved from the open position to the closed position, and upon the closed position being achieved, then the garage door locking apparatus 48 will then be activated to be moved from the unlatched position to the latched position.

Mounted on the right side door jamb 22 directly adjacent the floor 26 is a latch plate 54. The latch plate 54 includes a hole 56. The latch plate 54 is fixedly mounted by bolts 58 to the right side door jamb 22. Fixedly mounted onto the garage door by means of bolts 60 is a support plate 62. The support plate 62 has a right angled flange 64 which includes a hole 66. Hole 66 is the same size and shape as hole 56 and is to be alignable with hole 56 when the garage door 30 is in the closed position. The support plate 62 also includes a sleeve 68. Telescopingly received within the sleeve 68 is an outer segment 70 of a draw bar assembly 72. The outer segment 70 would normally be constructed of hollow bar stock and would be metallic and rigid. The outer segment 70, after passing through the sleeve 68, automatically aligns with the hole 66. The outer segment 70 is connected by means of bolt 74 to resilient member 76. Typical material for the resilient member 76 would be a semi-rigid rubber composition. The resilient member 76 is connected by bolts 78 to center segment 80 of the draw bar assembly 72. The center segment 80 would normally be constructed of the same material as the outer segment 70 and will be of the same size. The center segment 80 is mounted in conjunction with a support sleeve 82 which is fixably mounted onto the garage door 30. It is the function of the support sleeve 82 to provide support for the draw bar assembly 72 but yet permit lineal movement of the draw bar assembly 72.

The center segment 80 is then connected by bolts 84 to another resilient member 86. The resilient member 86 is then connected by a bolt 88 to an inner segment 90 of the draw bar assembly 72. The inner segment 90 will be constructed of the same material as the center segment 80. The inner segment 90 is telescopingly mounted within a sleeve 92 which is fixedly mounted on a support plate 94. The support plate 94 is fixedly mounted by bolts 96 to the structure of the garage door 30.

Figure 6:
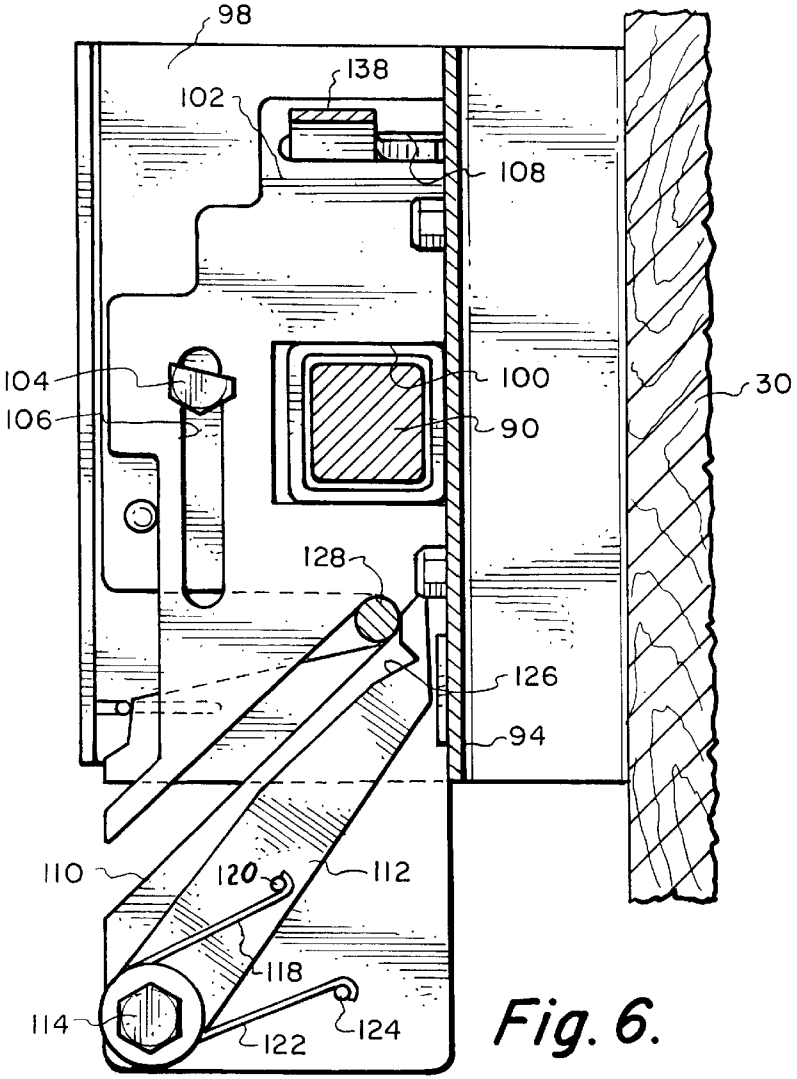
FIG. 6 is a across-sectional view taken along line 6—6 of FIG. 4.
Figure 8:
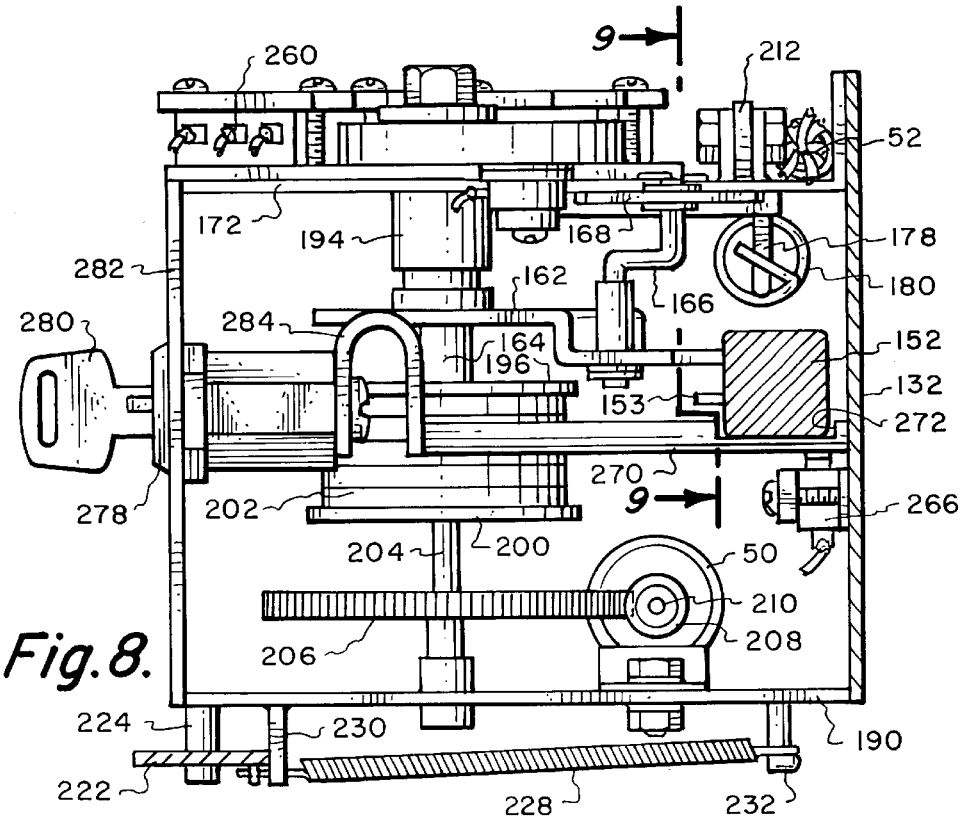
FIG. 8 is a cross-sectional view taken along line 8—8 of FIG. 4.
Figure 14:
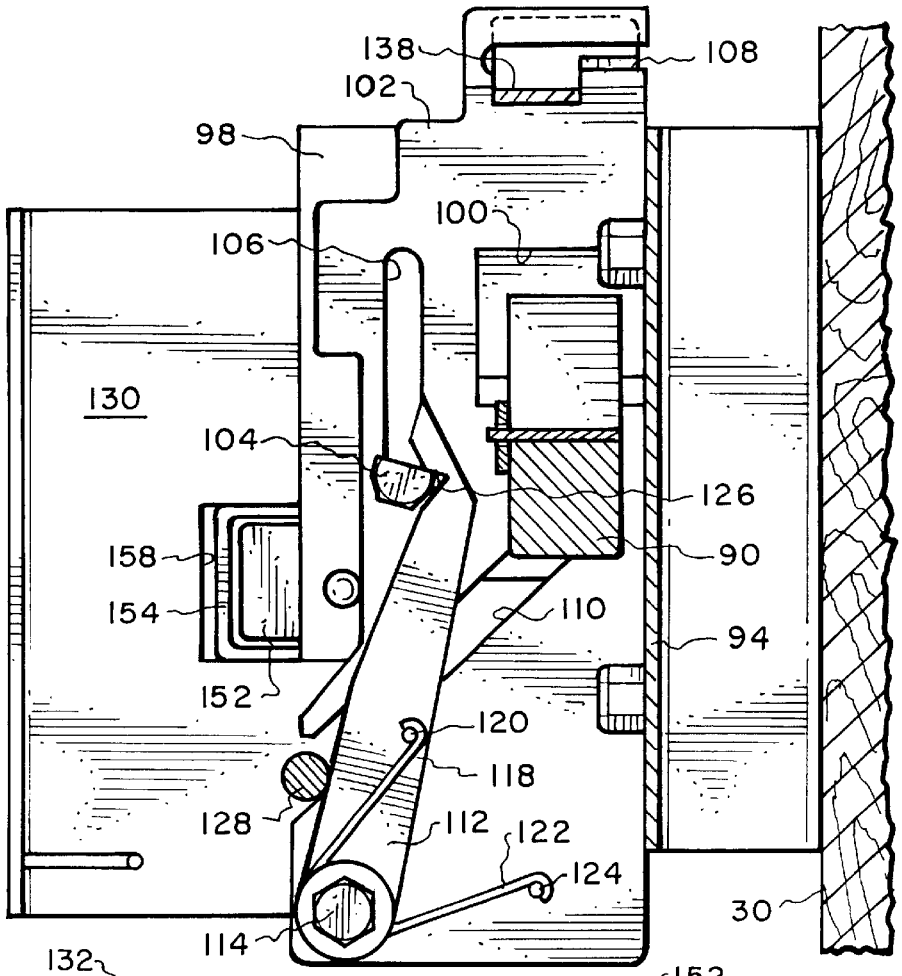
FIG. 14 is a cross-sectional view taken along line 14—14 of FIG. 13.
Figure 16:
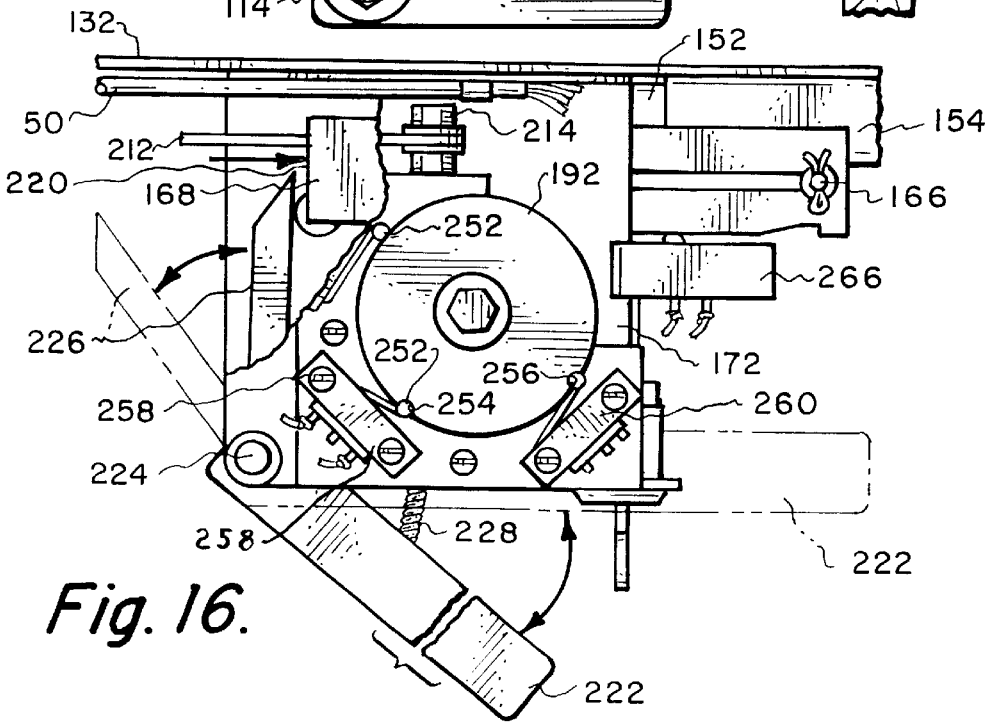
FIG. 16 is an end view of the drive mechanism, included within the present invention, depicting the operation of the manual reset included within this invention.
Figure 17:
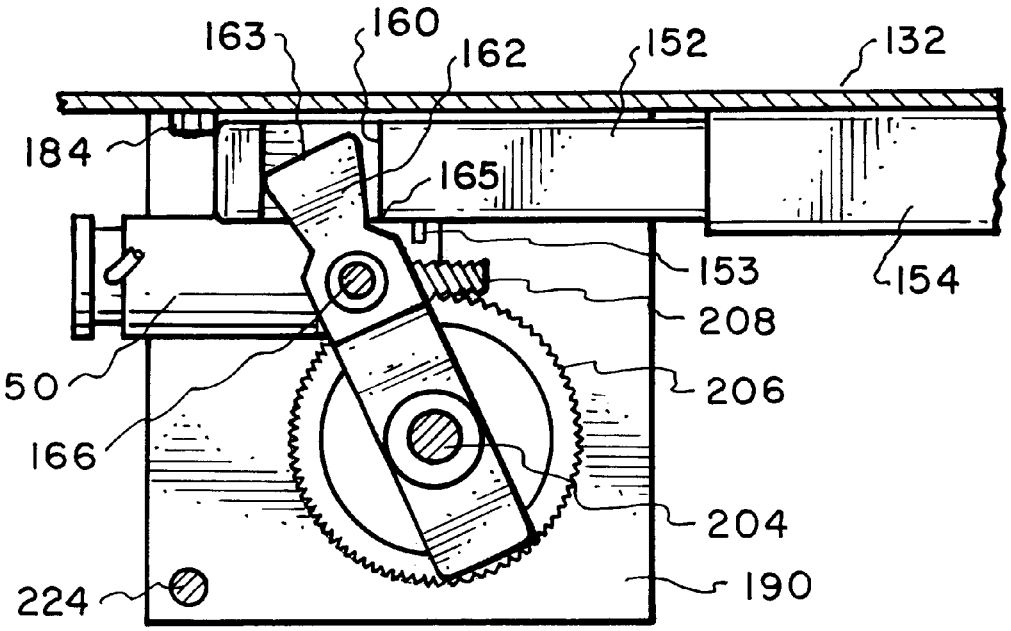
FIG. 17 is a side view, partly in cross-section, of the connection between a lever which moves the primary draw bar segment with the draw bar assembly in the unlatched position taken along line 17—17 of FIG. 13.
Figure 18:
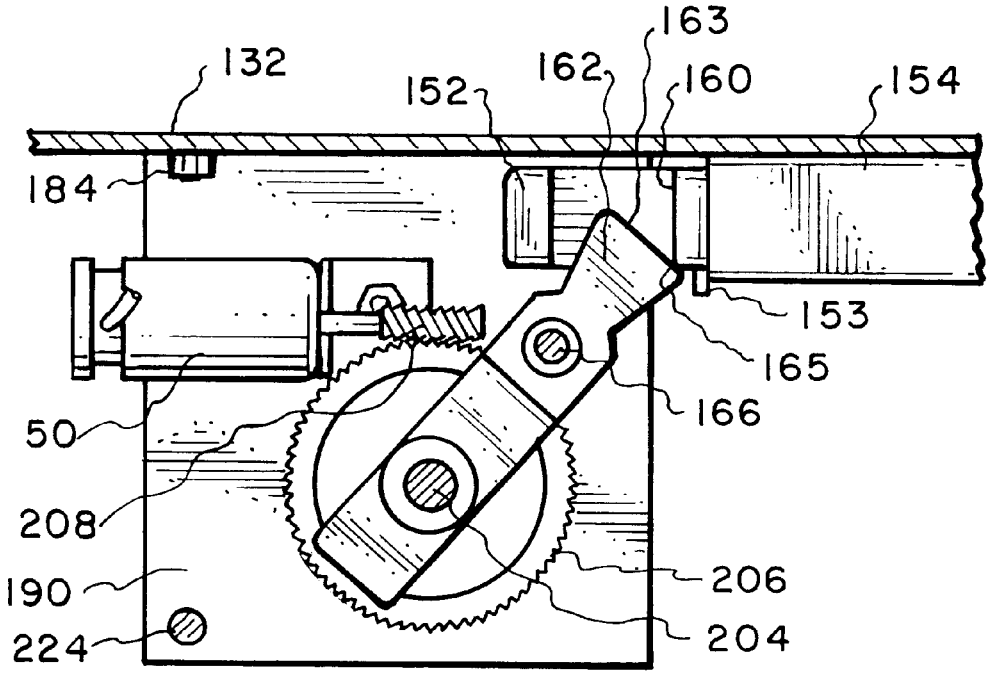
FIG. 18 is a view similar to FIG. 17 but showing the primary draw bar segment in the latched position taken along line 18—18 of FIG. 4.

The support plate 94 includes a right angled flange 98. Flange 98 includes a hole 100. The inner segment 90, after passing through the sleeve 92, is to be aligned with and capable of passing through the hole 100. Mounted against the flange 98 is a slide lock-out plate 102. Slide lock-out plate 102 is held against the flange 98 by means of headed bolt 104 which connects with elongated slot 106. Slide lock-out plate 102 includes a cut-out slot 108 and an angled slot 110. Mounted on the slide lock-out plate 102 is a biased latch arm 112. The biased latch arm 112 is pivotally mounted by bolt 114 to the slide lock out plate 102. Mounted on the bolt 114 is a coil spring 116. One end 118 of the coil spring 116 connects with pin 120 which is fixedly mounted onto a bias latch arm 112. The opposite end 122 of the coil spring 116 connects with pin 124 which is mounted on the slide lock out plate 122. The coil spring 116 exerts a constant bias tending to pivot the bias latch arm 112 counterclockwise, and with the headed bolt 104 in the lower end of the elongated slot 106, the notch 126 formed in the outer end of the bias latch arm 112 will engage with the headed bolt 104. This will be the position when the garage door 30 is open. When the garage door 30 is moved to the closed position, and just prior to the garage door 30 becoming closed, a pin 128 will connect with the angle slot 110. As the garage door 30 further closes, the pin 128 will ride along angle slot 110 linearly moving the slide lock-out plate 102 from the position shown in FIG. 14 to the position shown in FIG. 6. At the same time the bias latch arm 112 is pivoted clockwise. The pin 128 is mounted on right angled flange 130 of a drive support plate 132. The right angled flange 130 has attached at its outer end a stop flange 134. The function of the stop flange 134 is to define the inward limit of movement of the garage door 30, and when the flange 98 abuts against the flange 134, this inward limit of movement is defined when inner segment 90 is aligned with hole 100.

Figure 4:
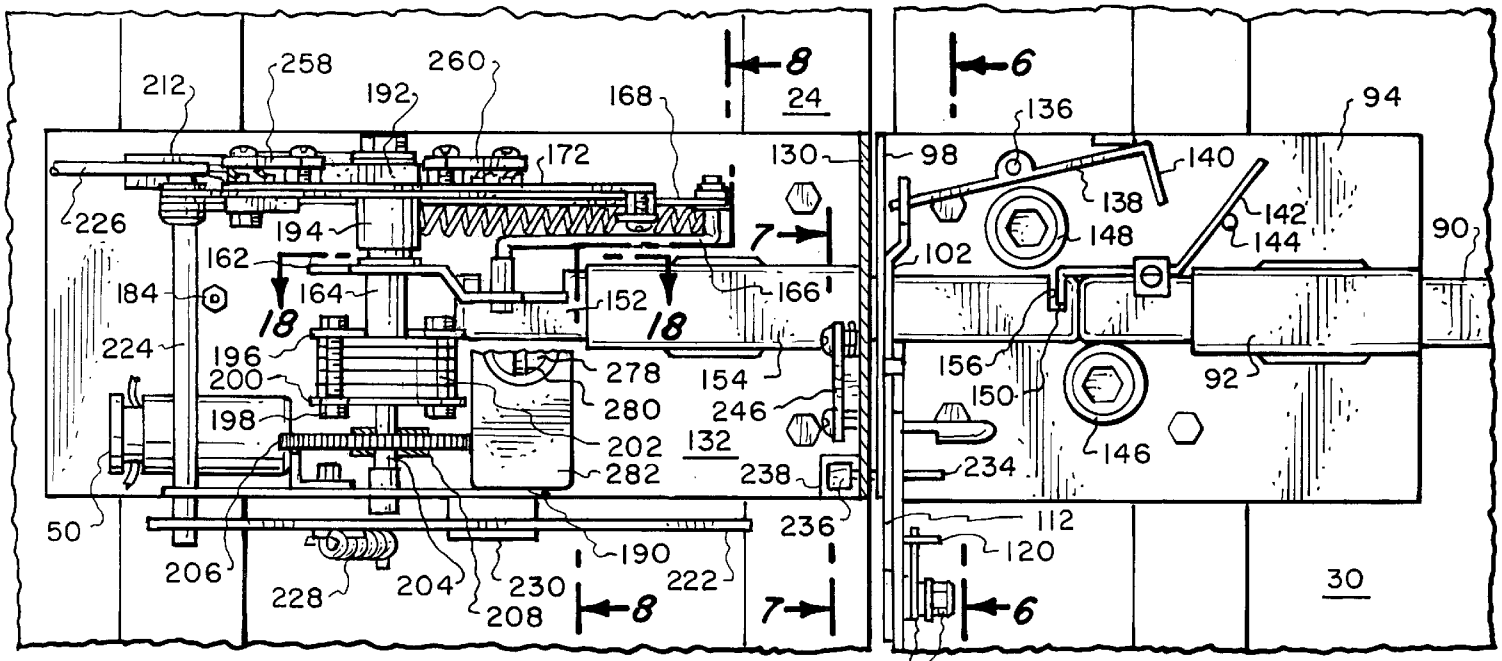
FIG. 4 is a partial cross-sectional view through the drive mechanism taken along line 4—4 of FIG. 2.
Figure 5:
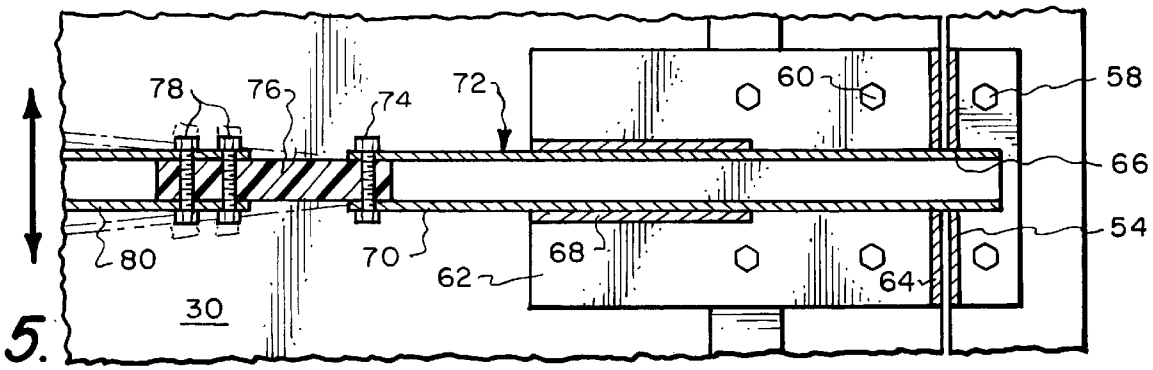
FIG. 5 is a cross-sectional view taken along line 5—5 of FIG. 3.
Figure 7:
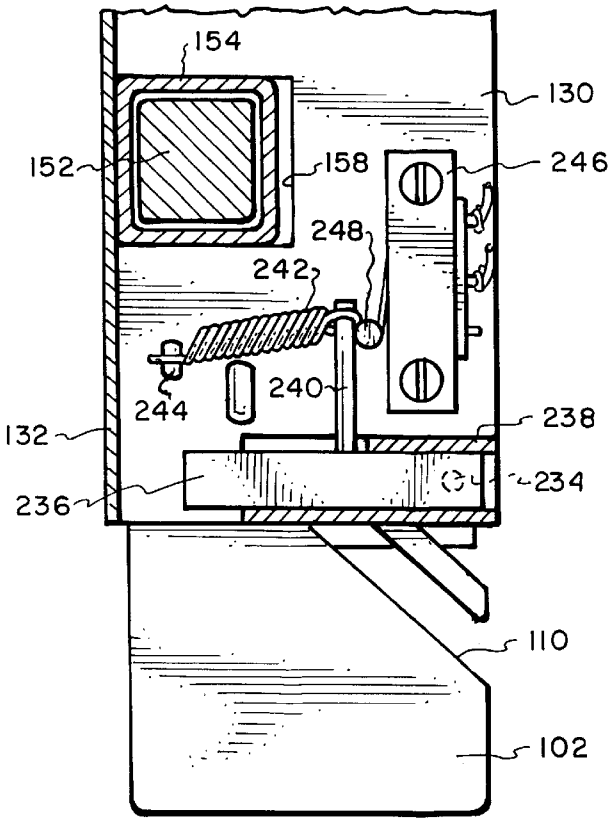
FIG. 7 is a cross-sectional view taken along line 7—7 of FIG. 4.
Figure 13:
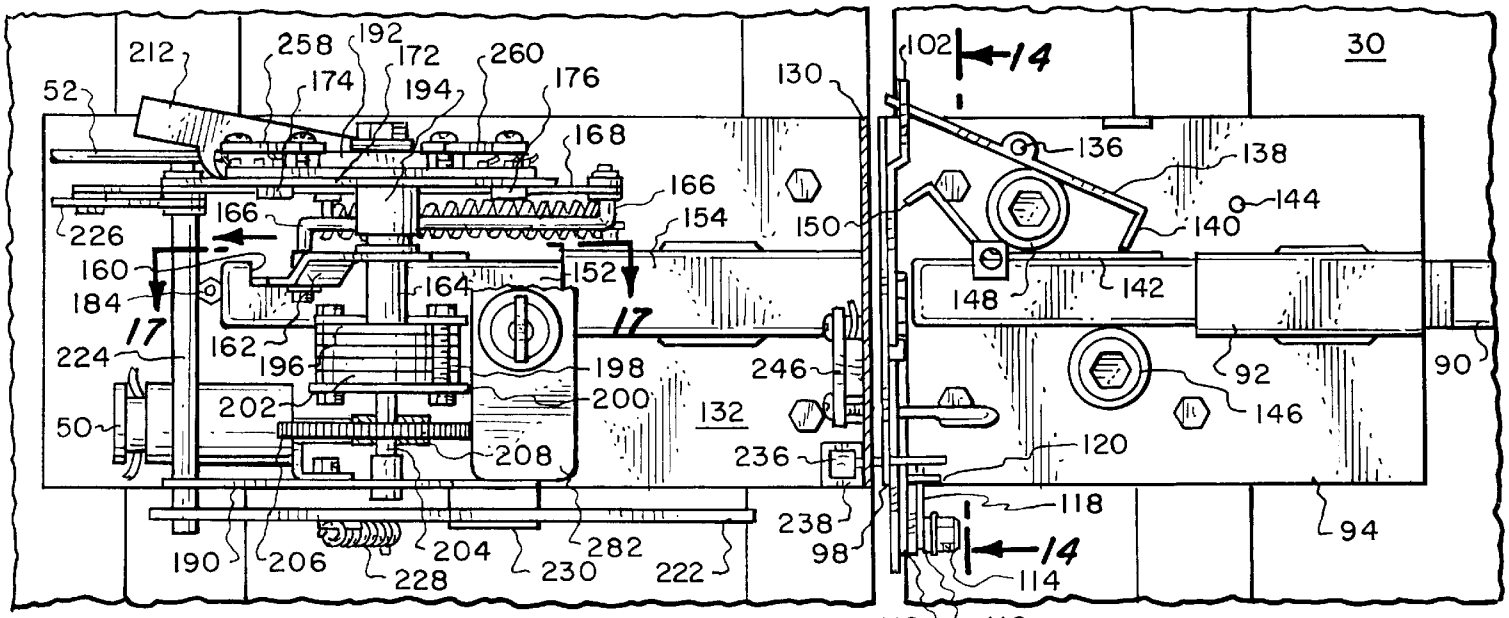
FIG. 13 is a side view taken along line 13—13 of FIG. 11.

Fixedly mounted onto the support plate 94 is a pin 136. Pivotally mounted on the pin 136 is a lever 138. The inner end of the lever 138 is located within the cutout slot 108. The opposite end of the lever 138 is formed into a right angled extension 140. The right angled extension 140 is capable of coming into contact with a bar latch 142 which is pivotally mounted onto the inner segment 90. During linear movement of the inner segment 90, the bar latch 142 is capable of being moved from the unlatching position, shown in FIG. 13, to the latched position shown in FIG. 4, and when in the latched position, the bar latch 142 is in contact with pin 144 which is fixedly mounted onto support plate 94. The inner segment 90 rides on a roller bearing 146. The roller bearing 146 is fixedly mounted onto the support plate 94. The bar latch 142 connects with a similar roller bearing 148. This roller bearing 138 is also mounted onto the support plate 94.

When the inner segment 90 is moved in a direction toward the slide lock-out plate 102, the roller bearing 148 will cause the latching end 150 of the bar latch 142 to be pivoted to a spaced position away from the inner segment 90. This pivoting is assured by the right angled extension 140 coming against the outer end of the bar latch 142 pressing such down against the inner segment 90. This is again the unlatched position of the locking apparatus of the present invention which will permit the garage door 30 to be opened. However, the free end of the inner segment 90 is contactable by a primary draw bar segment 152 which is telescopingly mounted within a sleeve 154 which is fixedly mounted onto the drive support plate 132. The primary draw bar segment 152 includes a notch 156. With the primary draw bar segment 152 fully extended and passing through hole 158 of the right angled flange 130 and hole 100 of the slide lock-out plate 102 and into contact with the inner segment 90 and forcing of inner segment 90 to the far right position shown in FIG. 4, the latching end 150 will engage with the notch 156. The fully extended position of the primary draw bar segment 152 occurs when pin 153, which is mounted on the segment 152, contacts sleeve 154. In essence, the inner segment 90 and the primary draw bar segment 152 are then connected together with also the outer segment 70 being located within the aligned holes 56 and 66. The garage door 30 is now latched.

The primary draw bar segment 152 includes a cutout 160. Within the cutout 160 is located one end of a lever 162. The lever 162 is pivotally mounted on a center shaft 164. Also, one end of a rod 166 is connected to the lever 162. The portion of the lever 162 that connects with primary draw bar segment 152 is rounded in order to freely pivot lever 162 between a first position and a second position relative to the primary draw bar segment 152. However, lever 162 has an engagement in the form of a flat face 163 which abuts against edge 165 of primary draw bar segment 152 when in the second position which is the latched position. This creates an "over center" lock which prevents movement of the primary draw bar segment 152 toward the first position which is the unlatched position. If a burglar thinks he or she can deactivate the locking apparatus by manually moving the draw bar assembly 72 to the unlatched position, such is not possible. Movement to the unlatched position can only occur by activating motor 50 as long as electricity is being supplied to the motor 50.

Figure 15:
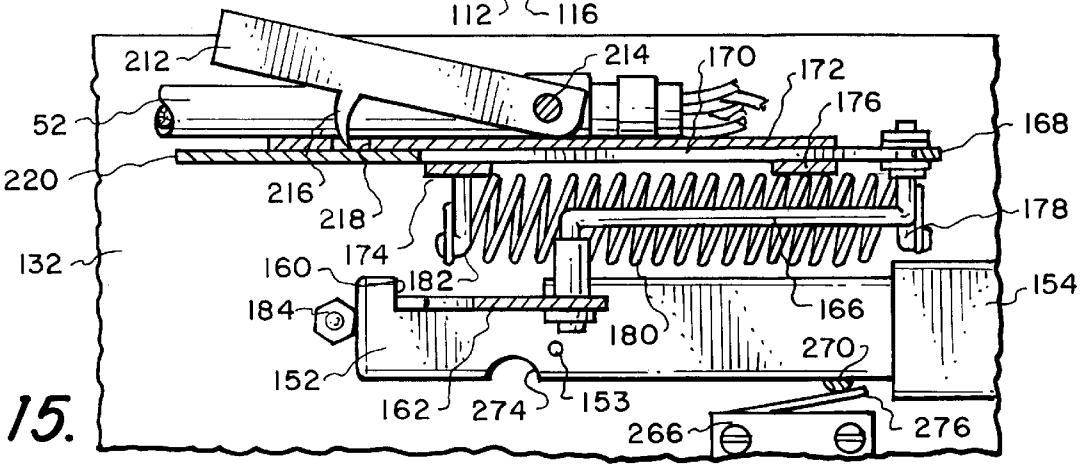
FIG. 15 is a cross-sectional view taken along line 15—15 of FIG. 11 showing the power failure release handle in the released position.

The opposite end of the rod 166 is mounted onto an elongated slot 170 of a slide plate 168. The slide plate 168 is mounted for lineal sliding movement on the slide wall 172 by means of a pair of spaced apart brackets 174 and 76. Fixedly mounted onto one end of the slide plate 168 is a pin 178. The pin 178 is connected to one end of a coil spring 180. The opposite end of the coil spring 180 is attached to pin 182 which is fixedly mounted onto the bracket 174. The function of the coil spring 180 is to exert a continuous bias on the slide plate 168 tending to locate such in the rearwardmost direction, which is shown in FIG. 15 of the drawings. This will also simultaneously tend to locate the primary draw bar segment 152 in its rearwardmost position in contact with stop pin 184 which is fixedly mounted onto the drive support plate 132. The drive support plate 132 is fixedly mounted by bolts 186 to the wall structure 188 within which is formed the left side door jamb 24.

The center shaft 164 is rotatably mounted between sidewall 172 and sidewall 190 which is located parallel but spaced apart from the sidewall 172. Both the sidewall 172 and sidewall 190 are integrally connected to the drive support plate 132. The center shaft 164 is fixedly mounted onto a wheel 192 which is mounted on the outside surface of the sidewall 172. Interiorly of the sidewall 172, the center shaft 164 is attached to a spacer bushing 194. Interiorly of the spacer bushing 194 is mounted the lever 162. The center shaft 164 is then fixedly secured to a clutch plate 196. Clutch plate 196 is fixedly secured by a series of bolts 198 to a clutch plate 200. In between the clutch plates 196 and 200 is mounted a series of clutch discs 202. The clutch discs 202 are fixedly mounted onto a center shaft extension 204. The center shaft extension has fixedly mounted thereon a gear wheel 206. It is to be understood that the longitudinal center axis of the center shaft extension 204 coincides with the longitudinal center axis of the center shaft 164. The center shaft extension 204 is then pivotally supported onto the sidewall 190.The gear wheel 206 is in engagement with a worm gear 208. The worm gear 208 is mounted on a motor shaft 210. The motor shaft 210 is rotated by means of the electric motor 50.

The purpose of the clutch comprising clutch plates 96 and 200, clutch discs 202 and bolts 198, is to prevent burning up of the motor 50. If for any reason the garage door 30 gets stuck in a particular position, or any portion of the overall mechanism jams, then the motor will continue to operate in the normal manner with slippage occurring between the clutch plates 196 and 198 and the clutch discs 202. In other words, relative movement will occur between center shaft 164 and center shaft extension 204. The amount of force required to cause slippage to occur between the discs 202 and plates 196 and 198 can be adjusted by loosening or tightening of bolts 198.

If, per chance, there is an electrical power failure, and the garage door locking apparatus of this invention is in the locked position, it will be necessary for the user, in order to open the garage door 30, to have the garage door locking apparatus of this invention moved to the unlatched position. This unlatching will have to be accomplished manually because of the lack of electrical power. It is for this reason that handle 212 is provided. Handle 212 is pivotally mounted by means of bolt assembly 214 to the sidewall 172. Handle 212 includes a protuberance 216 on its inner surface. Protuberance 216 connects with hole 218 formed within the sidewall 172. With the primary draw bar arrangement 152 in its full outwardly extended position, the draw bar 152 connects with the hole 158 and hole 100 thereby locking of the garage door 30. Also, outer segment 70 is located within the hole 66. The slide plate 168 is positioned far enough to the right in FIG. 15 so that protuberance 216 passes through the hole 218 and abuts against the back end 220 of the slide plate 168. Therefore, the protuberance 216 prevents the slide plate 168 from moving to the left in FIG. 15 even though it is encouraged to do so by the coil spring 180. However, upon the user grasping the handle 212 and moving such in an outward direction causing protuberance 216 to disconnect from the back end 220, the slide plate 168 will then move to the position shown in FIG. 15. The result is the primary draw bar segment 152 is then disengaged from the holes 100 and 158 and at the same time the secondary draw bar, composed of draw bar segments 90, 80 and 70, is also moved so that draw bar segment 70 is disconnected from the hole 66. The garage door locking mechanism of this invention is now in the unlatched position which will then permit the user to manually open the garage door 30. Switch 267 functions to cut power to motor 50 after handle 212 is pulled. Switch 267 opens when slide plate 168 is moved rearwardly.

Figure 9:
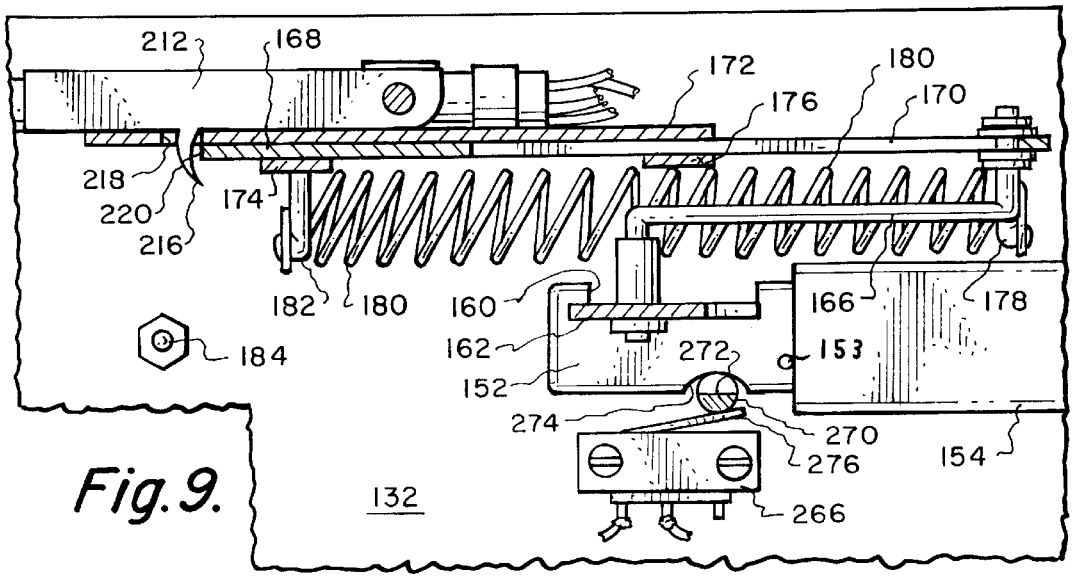
FIG. 9 is a cross-sectional view taken along line 9—9 of FIG. 8 which shows the vacation lock feature in the unlocked position.
Figure 11:
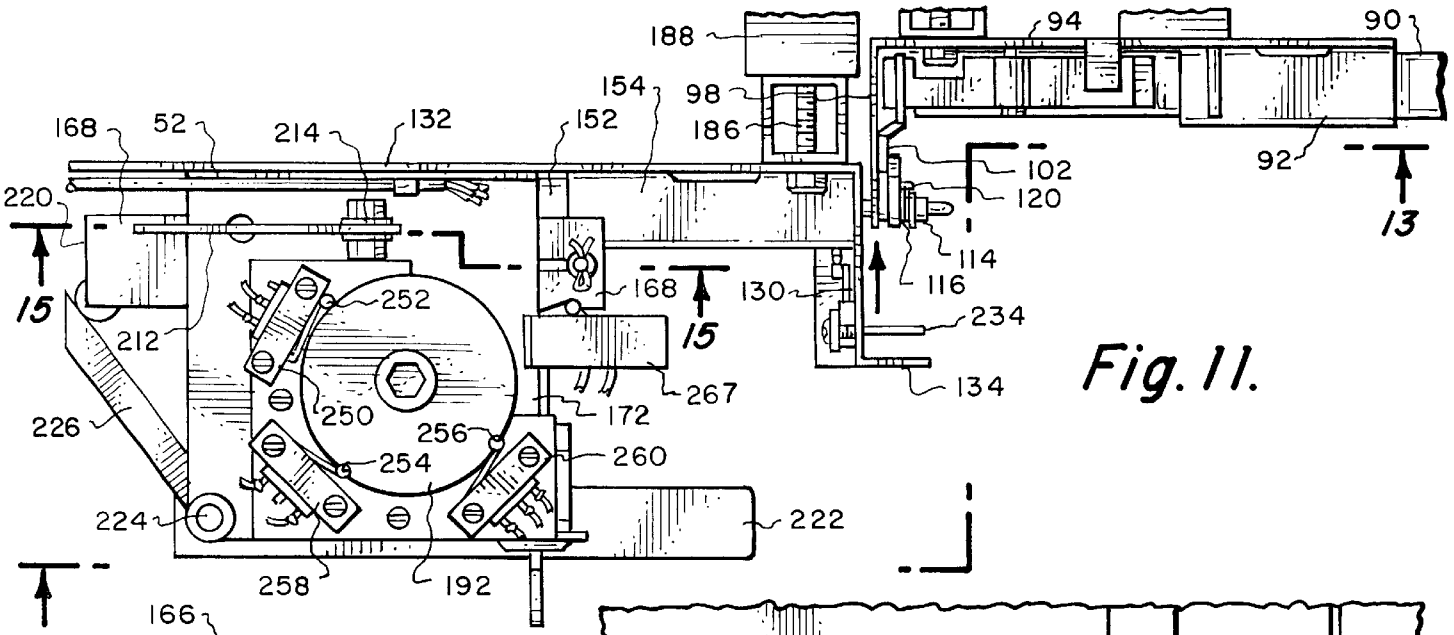
FIG. 11 is a view similar to FIG. 2 but showing the draw bar assembly in e unlocked position.
Figure 12:
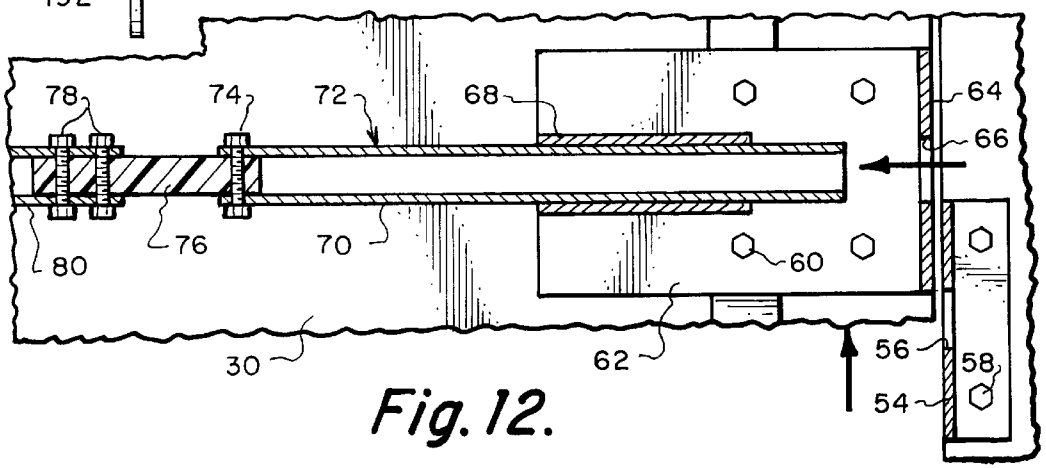
FIG. 12 is a view similar to FIG. 3 but cross-sectionally showing the draw bar dead bolt type of locking arrangement in the unlatched position.

Let it now be assumed that the electrical power has now returned and the user wishes to place the garage door locking apparatus of this invention in its normal mode for operation. In order to achieve this, slide plate 168 has to be moved back so that the back end 220 again rides against the protuberance 216 with the handle 212 abutting against sidewall 172. In order to achieve this, there is provided a reset handle 222 which is fixedly secured to a pivot rod 224. The pivot rod 224 is mounted between sidewalls 172 and 190. Adjacent wall 172 is the pivot rod 224 which is fixedly secured to a lever 226. Handle 222, when at rest, is positioned against the stop plate 230. The coil spring 228 connects between the handle 222 and pin 232 which is fixedly mounted onto the sidewall 190. When the handle 222 is pivoted against the bias of the spring 228 away from the stop plate 230, the lever 226 is caused to be moved against the back end 220 of the slide plate 168 and the outward pivoting motion of the reset handle 222 will result in the slide plate 168 being moved back to the position shown in FIG. 9 of the drawings so that the protuberance 216 can be conducted through hole 218 to reconnect with the back end 220.

When the garage door 30 is moved to the closed position, the door 30 contacts pin 234. Pin 234 is fixedly mounted onto the rod 236. Rod 236 is slidingly mounted within a sleeve 238. Sleeve 238 is fixedly mounted onto right angled flange 130. Fixedly attached to the rod 236 is a pin 240. Pin 240 is connected by a coil spring 242 to bracket 244. Bracket 244 is fixedly mounted onto right angled flange 130. Also mounted on the right angled flange 130 is a microswitch 246. When the garage door contacts pin 234, the rod 236 is slid within the sleeve 238 which results in the pin 240 coming into contact with the follower 248 of the microswitch 246 closing the microswitch 246. This closes the circuit to the control circuitry, which is not shown. The control circuitry activates the motor drive circuit to cause the draw bar assembly 72 to be located in the latched position. Microswitch 250 is mounted on the sidewall 172 and connects with the wheel 192. Microswitch 250 is a limiting switch. This switch 250 cuts the power to the motor drive circuit, hence to the motor 50. The switch 250 is closed by the wheel 192 with the follower 252 not being located within one of the two notches 254 and 256 formed within the wheel 192. When the garage door is latched, the notch 254 connects with the follower 252 and the microswitch 250 is opened which cuts the power to the motor circuit. Microswitches 258 and 260 are also in engagement with the wheel 192. Microswitch 260 is in the position of transmitting electrical power when the garage door is in the latched position. Both microswitches 258 and 260 are in the on position. The function of switch 258 is to activate a timer circuit which reverses polarity of the motor circuit so the motor can now reverse the next time it is actuated. Microswitch 260 is a dual function switch. When it is not engaged with notch 256, it prevents the garage door opening circuit from activating and opening the garage door by the automatic garage door opener 36. When the microswitch 260 is engaged with notch 256, the microswitch 260 closes activating the automatic garage door opening circuit of the automatic garage door opener 36. The function of microswitch 258 ensures that the automatic garage door opener 36 cannot be opened until the garage door locking apparatus of this invention is in the unlatched position.

Figure 10:
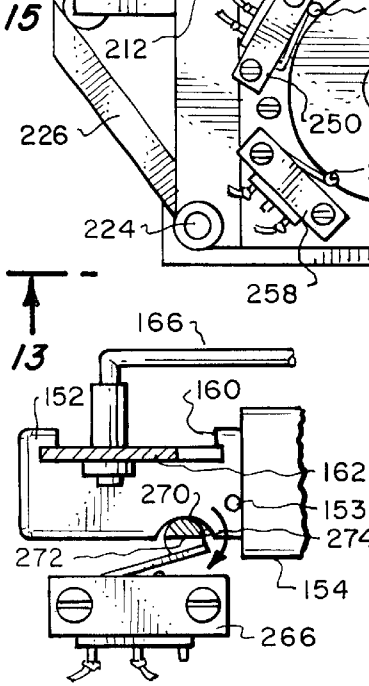
FIG. 10 is a cross-sectional view similar to a portion of FIG. 9 showing the vacation lock feature in the locked position.

Microswitch 266 is a power cut-off switch. The microswitch 266 is controlled by rod 270. Rod 270 includes a cutout notch 272. The primary draw bar segment 152 normally slides within the notch 272. However, when rod 270 aligns with notch 274 formed within the primary draw bar segment 152, the rod 270 can then be pivoted one hundred eighty degrees permitting the rod 270 to fall within the notch 274 and the follower 276 will then come to rest within the cutout notch 272. This will cause the microswitch 266 to open which cuts the power to the motor 50. This means that the garage door locking apparatus of this invention cannot be operated and it is locked in the latched position. This locking in the latched position is achieved by key lock 278 which is to be operated by key 280. This is to be deemed the vacation key lock feature which is to be utilized when the user is on vacation in order to maintain the garage door locking apparatus of this invention in the locked position. It is to be understood that the key 280 is to be removed and retained by the user requiring the key 280 to be reinserted and operate the lock 280 which will then pivot the rod 270 out of the notch 274 which will then permit the primary draw bar segment 152 to be retracted and the garage door 30 unlatched. The key lock 278 is mounted within cross member 282 which is fixedly secured between the sidewalls 172 and 190. The rod 270 is fixedly secured to U-shaped bracket 284 which in turn is pivotally mounted by the lock mechanism of the key lock 278. For a view showing the position of the rod 270 in engagement with the notch 274, reference is to be had to FIG. 10 of the drawings.

It is to be understood that the garage door locking apparatus 48 could be used with any type of garage door, such as a "roll up" door.

What is claimed is:

1. A locking apparatus for a garage door adapted to be locked to a door jamb comprising:

a draw bar segment mounted within said locking apparatus, said draw bar segment being linearly movable between a latched position engaged with the door jamb and an unlatched position spaced from the door jamb, said draw bar segment being linearly movable between said latched position and said unlatched position;

a lever which continuously connects by a means for connecting with said draw bar segment, said lever being pivotable between a first position and a second position, with said lever in said first position said draw bar segment being in said unlatched position, with said lever in said second position said draw bar segment being in said latched position;

an electrically operated motor connected by structure to said lever, said electrically operated motor to cause said pivotable movement of said lever; and said draw bar segment including a cutout, said means for connecting comprising an end of said lever which is mounted within said cutout.

2. The locking apparatus as defined in claim 1 wherein:

said end of said lever located within said cutout including a flat face, said draw bar segment having an edge at said cutout, with said draw bar segment in said latched position said flat face abutting against said edge preventing manual movement of said draw bar segment by the application of a manual force directly to said draw bar segment.

3. The locking apparatus as defined in claim 2 wherein:

said structure including a gear wheel and a worm gear, said motor having an output shaft, said worm gear being mounted on said output shaft, said gear wheel being in continuous engagement with said worm gear, said gear wheel being directly connected to said lever, whereby operation of said motor rotates said worm gear and pivotly turns said gear wheel which results in pivotal movement of said lever between said first position and said second position.

4. A locking apparatus as defined in claim 3 wherein:

a clutch mounted between said lever and said gear wheel, said clutch functioning to prevent jamming of said locking apparatus and damage to said motor.

5. A locking apparatus for a garage door adapted to be locked to a door jamb comprising:

a draw bar segment mounted within said locking apparatus, said draw bar segment being linearly movable between a latched position engaged with the door jamb and an unlatched position spaced from the door jamb, said draw bar segment being linearly movable between said latched position and said unlatched position;

a lever which continuously connects by a means for connecting with said draw bar segment, said lever being pivotable between a first position and a second position, with said lever in said first position said draw bar segment being in said unlatched position, with said lever in said second position said draw bar segment being in said latched position;

an electrically operated motor connected by structure to said lever, said electrically operated motor to cause said pivotable movement of said lever; and said structure including a gear wheel and a worm gear, said motor having an output shaft, said worm gear being mounted on said output shaft, said gear wheel being in continuous engagement with said worm gear, said gear wheel being directly connected to said lever, whereby operation of said motor rotates said worm gear and pivotly turns said gear wheel which results in pivotal movement of said lever between said first position and said second position.

6. The locking apparatus as defined in claim 5 a clutch mounted between said lever and said gear wheel, said clutch functioning to prevent jamming of said locking apparatus and damage to said motor.

* * * * *